US009711885B2

(12) United States Patent
Hamai et al.

(10) Patent No.: US 9,711,885 B2
(45) Date of Patent: Jul. 18, 2017

(54) FIXING STRUCTURE OF SEPARATE LEAF SPRING

(75) Inventors: Tsuyoshi Hamai, Makinohara (JP); Takuya Hasegawa, Fujieda (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/005,470

(22) PCT Filed: Jun. 22, 2012

(86) PCT No.: PCT/JP2012/066625

§ 371 (c)(1),
(2), (4) Date: Sep. 16, 2013

(87) PCT Pub. No.: WO2012/176936

PCT Pub. Date: Dec. 27, 2012

(65) Prior Publication Data

US 2014/0011410 A1 Jan. 9, 2014

(30) Foreign Application Priority Data

Jun. 24, 2011 (JP) ..... 2011-140765

(51) Int. Cl.
*H01R 9/20* (2006.01)
*H01R 13/187* (2006.01)

(52) U.S. Cl.
CPC ..... *H01R 13/187* (2013.01); *H01R 9/20* (2013.01)

(58) Field of Classification Search
CPC ..... H01R 13/187
USPC ..... 439/517, 958, 775–878
See application file for complete search history.

(56) References Cited

U.S. PATENT DOCUMENTS 2,765,452 A * 10/1956 Tuchel ..... 439/852
5,326,273 A * 7/1994 Kamon ..... H01R 4/62 174/94 R
5,340,338 A 8/1994 Sai et al.
6,196,884 B1 * 3/2001 Tanaka ..... 439/847
6,290,553 B1 9/2001 Sato et al.
(Continued)

FOREIGN PATENT DOCUMENTS

CN 101291025 A 10/2008
DE 10 2007 057 482 A1 5/2008
(Continued)

OTHER PUBLICATIONS

International Search Report dated Oct. 31, 2012 issued in International Application No. PCT/JP/2012/066625 (PCT/ISA/210).
(Continued)

*Primary Examiner* — Renee Luebke
*Assistant Examiner* — Paul Baillargeon
(74) *Attorney, Agent, or Firm* — Sughrue Mion, PLLC

(57) ABSTRACT

A fitting cylinder section 11 of a female terminal main body 10 includes a first side plate 11*a* from which a columnar body 15 for a rivet protrudes as one in a plurality of side wall plates forming a square cylinder shape, a leaf spring 20 fixed to the fitting cylinder section 11 has a rivet insertion hole 21*a* into which the columnar body 15 for the rivet can be inserted, and the fitting cylinder section 11 has a structure in which the leaf spring 20 is fixed to an inner section thereof by performing the press-molding in the square cylinder shape section after rivet-retaining the leaf spring 20 to the first side plate 11*a* in a deployment shape and before performing the press-molding in the square cylinder shape.

7 Claims, 8 Drawing Sheets

(56) References Cited

U.S. PATENT DOCUMENTS

| | | | | |
|---|---|---|---|---|
| 7,018,247 | B1 | 3/2006 | Ranta et al. | |
| 7,374,460 | B1 | 5/2008 | Hariharesan et al. | |
| 7,465,199 | B2 * | 12/2008 | Osada | H01R 4/185 439/845 |
| 7,553,203 | B2 * | 6/2009 | Anbo | H01R 13/11 439/852 |
| 2008/0261460 | A1 | 10/2008 | Hariharesan et al. | |
| 2009/0075530 | A1 | 3/2009 | Schneider | |
| 2009/0088012 | A1 | 4/2009 | Oooka | |
| 2009/0291600 | A1 * | 11/2009 | Kutsuna | 439/845 |
| 2011/0076886 | A1 * | 3/2011 | Hariharesan et al. | 439/595 |
| 2014/0148064 | A1 | 5/2014 | Lampert et al. | |

FOREIGN PATENT DOCUMENTS

| | | | |
|---|---|---|---|
| EP | 0 893 850 | A2 | 1/1999 |
| JP | 6-19276 | U | 3/1994 |
| JP | 2000-323217 | A | 11/2000 |
| JP | 2004-006070 | A | 1/2004 |

OTHER PUBLICATIONS

Written Opinion dated Oct. 31, 2012 issued in International Application No. PCT/JP2012/066625 (PCT/ISA/237).

Communication dated Sep. 17, 2014 from the Korean Intellectual Property Office in a counterpart Korean application No. 10-2013-7023959.

Office Action, Issued by the Japan Patent Office, Dated Feb. 10, 2015, in counterpart Japanese Application No. 2011-140765.

Office Action, Issued by the State Intellectual Property Office of P.R. China, Dated Feb. 28, 2015, in counterpart Chinese Application No. 201280013323.3.

Office Action, dated Aug. 25, 2015, issued by the State Intellectual Property Office of P.R.China in counterpart Chinese Application No. 201280013323.3.

Office Action issued on Feb. 6, 2016 by the State Intellectual Property Office of P.R. China in counterpart Chinese Application No. 201280013323.3.

* cited by examiner

FIXING STRUCTURE OF SEPARATE LEAF SPRING

TECHNICAL FIELD

The present invention relates to a fixing structure of a separate leaf spring which obtains a female terminal fitting of a structure in which a separate leaf spring is fixed into a fitting cylinder section of a female terminal main body formed by a press molding.

BACKGROUND ART

FIGS. 7 and 8 show a fixing structure of a separate leaf spring in a female type terminal fitting shown in PTL 1 described below.

A female type terminal fitting 101 shown herein includes a female terminal main body 110 which is formed by press molding of a metallic plate, and a leaf spring 120 made of a metallic plate which is formed separately from the female terminal main body 110 and is fixed to the female terminal main body 110.

The female terminal main body 110 includes a square cylinder shaped fitting cylinder section 111 into which a male terminal can be inserted, and an electric wire pressing section 112 connected to a back side of the fitting cylinder section 111. The fitting cylinder section 111 and the electric wire pressing section 112 are formed by performing the press-molding. In the fitting cylinder section 111, fixing holes 130 for fixing the leaf spring 120 are formed through both side plates 111*b* which are bent and molded on both sides of a bottom plate 111*a* in a standing state.

The leaf spring 120 is fixed and installed in the fitting cylinder section 111. The leaf spring 120 presses the male type terminal inserted into the fitting cylinder section 111, and causes the male type terminal and the fitting cylinder section 111 to be in a conduction state.

As shown in FIG. 7, the leaf spring 120 is provided with fixing pieces 121 for joining to the fitting cylinder section 111 on both sides thereof.

In the fixing structure of the separate leaf spring disclosed in PTL 1 described below, as shown in FIG. 7, before molding the side plates 111*b* onto both sides of the bottom plate 111*a* in the standing state, the leaf spring 120 is mounted on the bottom plate 111*a*. In that state, by bending the side plates 111*b* of both sides of the bottom plate 111*a* in the standing state, and fitting the fixing pieces 121 of the both sides of the leaf spring 120 to the fixing hole 130 of the both side plates 111*b*, a state where the fixing hole 130 is fixed into the fitting cylinder section 111 is obtained.

CITATION LIST

Patent Literature

[PTL1] JP-A-2000-323217

SUMMARY OF THE INVENTION

Technical Problem

However, in the fixing structure of the separate leaf spring in PTL 1, when the leaf spring 120 causes a positional deviation during press molding, the fixing pieces 121 interfere with the edges of the fixing holes 130 and cause damage to the leaf spring 120 or the like.

For that reason, there is a need for a precise positioning technology for preventing positional deviation of the leaf spring during press molding. Thus, in the case of PTL 1, as shown in FIG. 8, a positioning piece 115 for precisely positioning the leaf spring 120 on the bottom plate 111*a* is cut out and formed. The positioning piece 115 abuts against the back surface of the leaf spring 120 mounted on the bottom plate 111*a* and restricts the displacement of the leaf spring 120.

However, in the fixing structure of the separate leaf spring of PTL 1, since the positioning piece 115 for preventing the positional deviation of the leaf spring 120 is cut and formed, there has been possibility in that it is difficult to secure sufficient strength in the fitting cylinder section 111.

Furthermore, even if the positioning piece 115 is equipped, when the leaf spring 120 is minutely displaced due to impact or the like acting at the time of the bending of the side plate 111*b*, there has been possibility in that an attachment defect of the leaf spring 120 may occur. For that reason, there is a need for a high precision press molding process of lower impact so that positional deviation of the leaf spring 120 is not generated, and thus there is possibility in that it is difficult to improve the molding properties.

The present invention has been made in view of situations that are described above. It is an object of the present invention to provide a fixing structure of a separate leaf spring in which it is easy to secure strength in a fitting cylinder section to which a leaf spring is fixed, and it is possible to improve the molding properties of the female terminal main body.

Solution to Problem

In order to achieve the object, the present invention is achieved by a configuration described below.

(1) A fixing structure of a separate leaf spring in a female type terminal fitting, the fixing structure comprising:

a female terminal main body including a fitting cylinder section press-molded in a square cylinder shape and into which a male type terminal can be inserted; and a leaf spring formed separately from the female terminal main body and fixed to the fitting cylinder section so that the male type terminal can be pressed by the leaf spring;

wherein the fitting cylinder section includes a first side plate from which a rivet columnar body protrudes, as one in a plurality of side wall plates forming the female main body into the square cylinder shape;

the leaf spring has a rivet retaining section that has a rivet insertion hole into which the rivet columnar body can be inserted, and that is fixed to the first side plate by a rivet-retaining that clamps a top section of the rivet columnar body inserted to the rivet insertion hole; and the fitting cylinder section has a structure in which the leaf spring is fixed to an inner section of the fitting cylinder section by performing the press-molding in the square cylinder shape, after performing the rivet-retaining of the leaf spring in the first side plate in a deployment shape and before performing the press-molding in the square cylinder shape.

(2) The fixing structure of the separate leaf spring described in (1), wherein the leaf spring includes fixing pieces which protrude toward a second side plate of the fitting cylinder section that is bent and molded on both side edges of the first side plate in a standing state, and on both sides of the fixing plate connected to the rivet retaining section, and the second side plate of the fitting cylinder section includes a spring fixing hole into which the fixing piece is fitted to fix the both sides of the fixing plate when being molded in both edges of the first side plate from a deployment form of the fitting cylinder section in a standing state.

According to the configuration of (1) mentioned above, when performing the press-molding of the fitting cylinder section of the female terminal main body in a square cylinder shape, the separate leaf spring is fixed to the first side plate by the rivet-retaining in advance. Thus, when performing the press-molding of the fitting cylinder section of the female terminal main body, it is not necessary to cut and form a high precision positioning piece for preventing the positional deviation of the leaf spring in the fitting cylinder section. Furthermore, the position of the leaf spring does not deviate due to impact when performing the press-molding of the fitting cylinder section.

Thus, it is easy to secure strength in the fitting cylinder section to which the leaf spring is fixed. Furthermore, since there is no need for high precision press-molding of less impact, the molding properties of the female terminal main body can be improved.

According to the configuration of (2) mentioned above, since the fixing of the separate leaf spring to the fitting cylinder section is a double fixing structure of the rivet-retaining to the first side plate and a fitting structure in which the fixing piece equipped in the leaf spring is fitted to the spring fitting hole of the second side plate, reliability of the fixing to the separate spring can be improved.

Advantageous Effects of Invention

According to the fixing structure of the separate leaf spring of the present invention, when performing the press-molding of the fitting cylinder section of the female terminal main body in a square cylinder shape, the separate leaf spring is fixed to the first side plate by the rivet-retaining in advance. Thus, there is no need to cut and form the high precision positioning piece for preventing the positional deviation of the leaf spring when performing the press-molding of the fitting cylinder section of the female terminal main body, in the fitting cylinder section. Furthermore, the position of the leaf spring does not deviate due to the impact or the like when performing the press-molding of the fitting cylinder section.

Thus, it is easy to secure the strength in the fitting cylinder section to which the leaf spring is fixed. Furthermore, since there is no need for the high-precision press-molding of less impact, the molding properties of the female terminal main body can be improved.

DESCRIPTION OF EMBODIMENTS

Hereinafter, a preferred embodiment of a fixing structure of a separate leaf spring according to the present invention will be described in detail with reference to the drawings.

Figure 1:
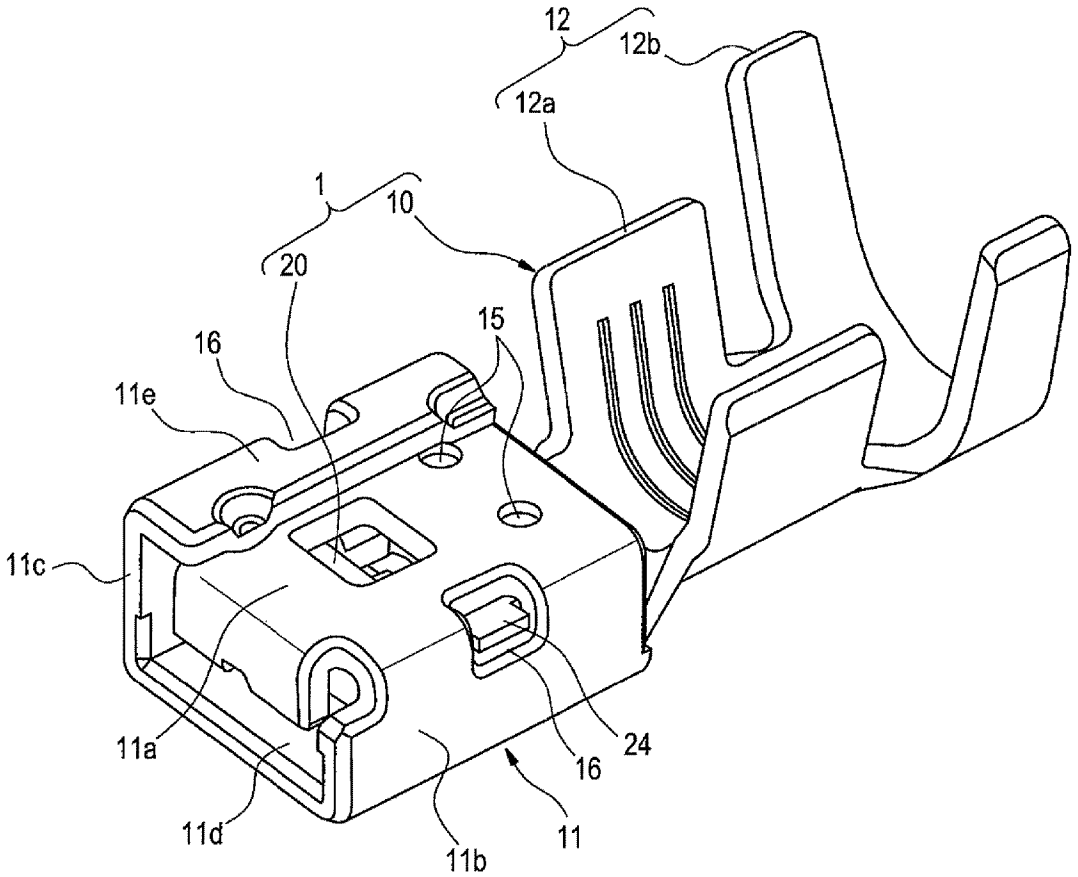
FIG. 1 is a perspective view of an embodiment of a female type terminal fitting to which a leaf spring is fixed by a fixing structure of a separate leaf spring according to the present invention.
Figure 2:
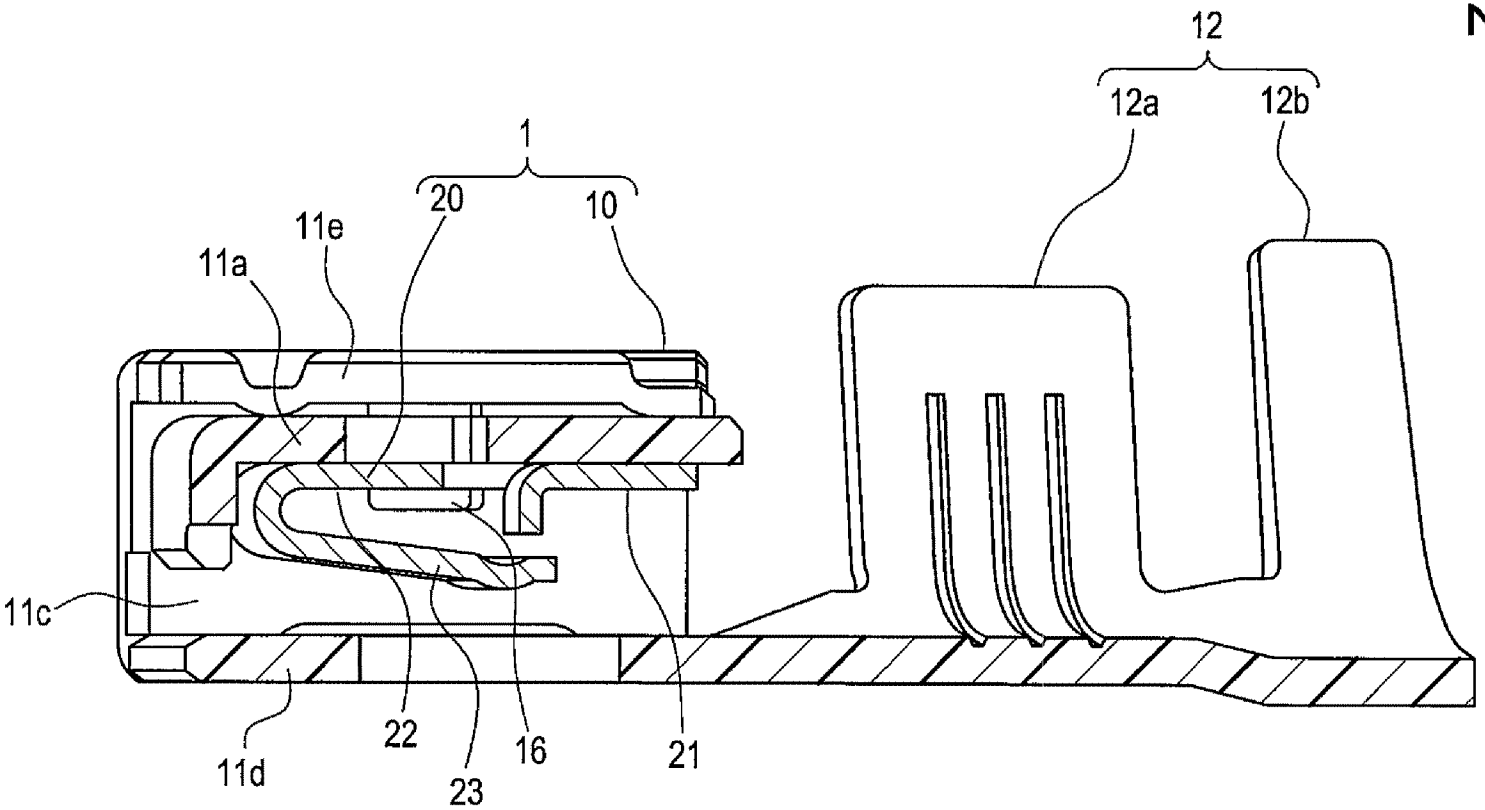
FIG. 2 is a longitudinal cross-sectional view of the female type terminal fitting shown in FIG. 1.
Figure 3:
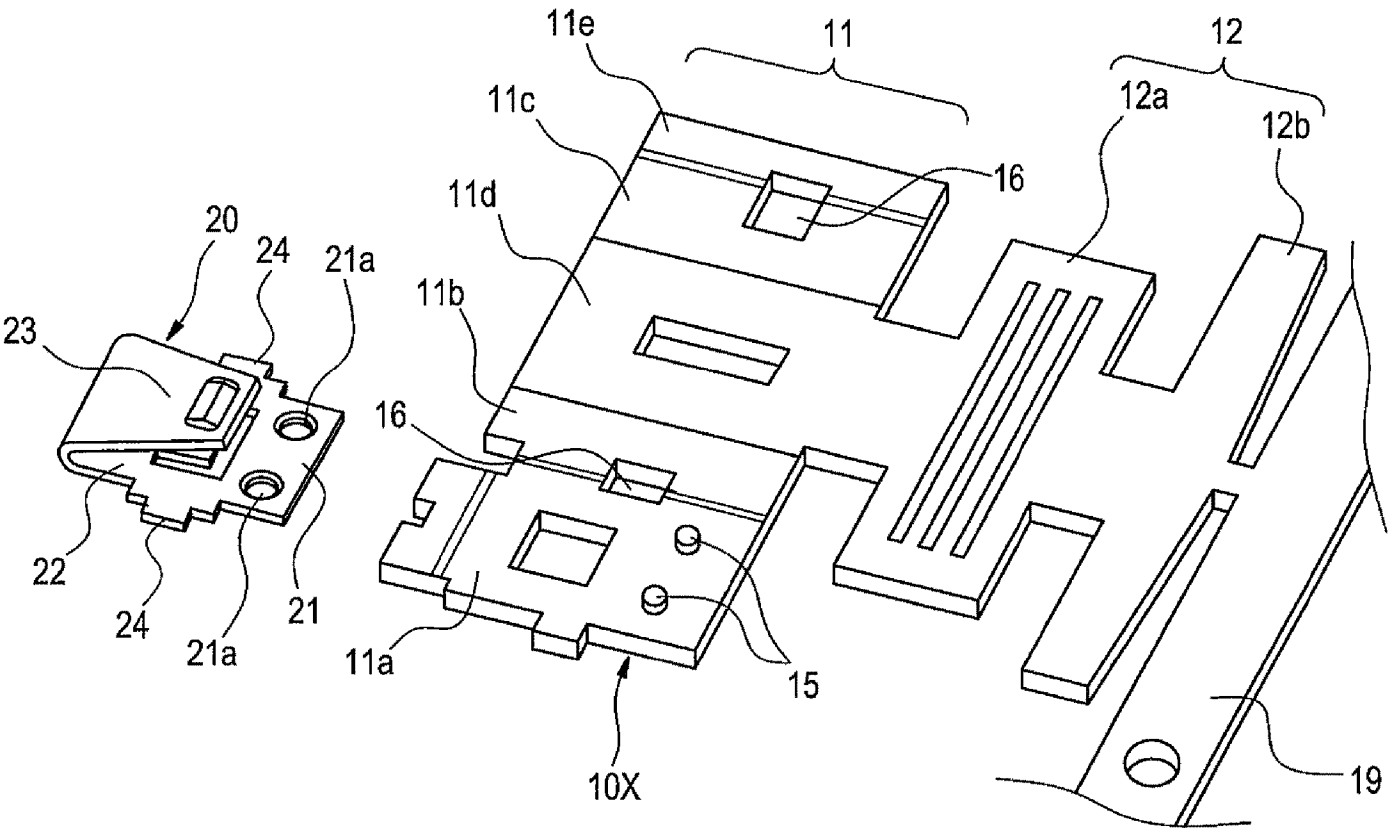
FIG. 3 is a perspective view of a deployment shape of a terminal base material formed in the female terminal main body shown in FIG. 1 and the separate leaf spring fixed to the female terminal main body.
Figure 4:
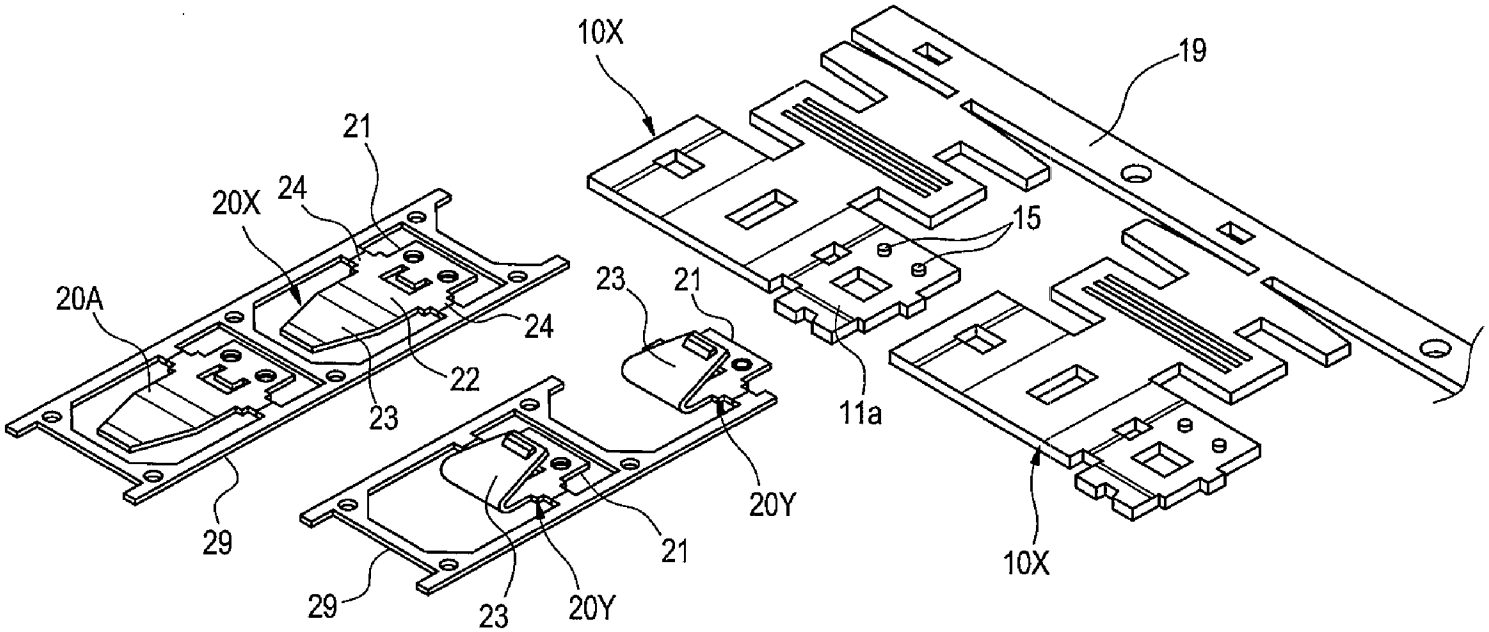
FIG. 4 is a perspective view of a first punching plate material continuously formed with a plurality of terminal base materials shown in FIG. 3 and a second punching plate material continuously formed with a plurality of leaf springs.
Figure 5:
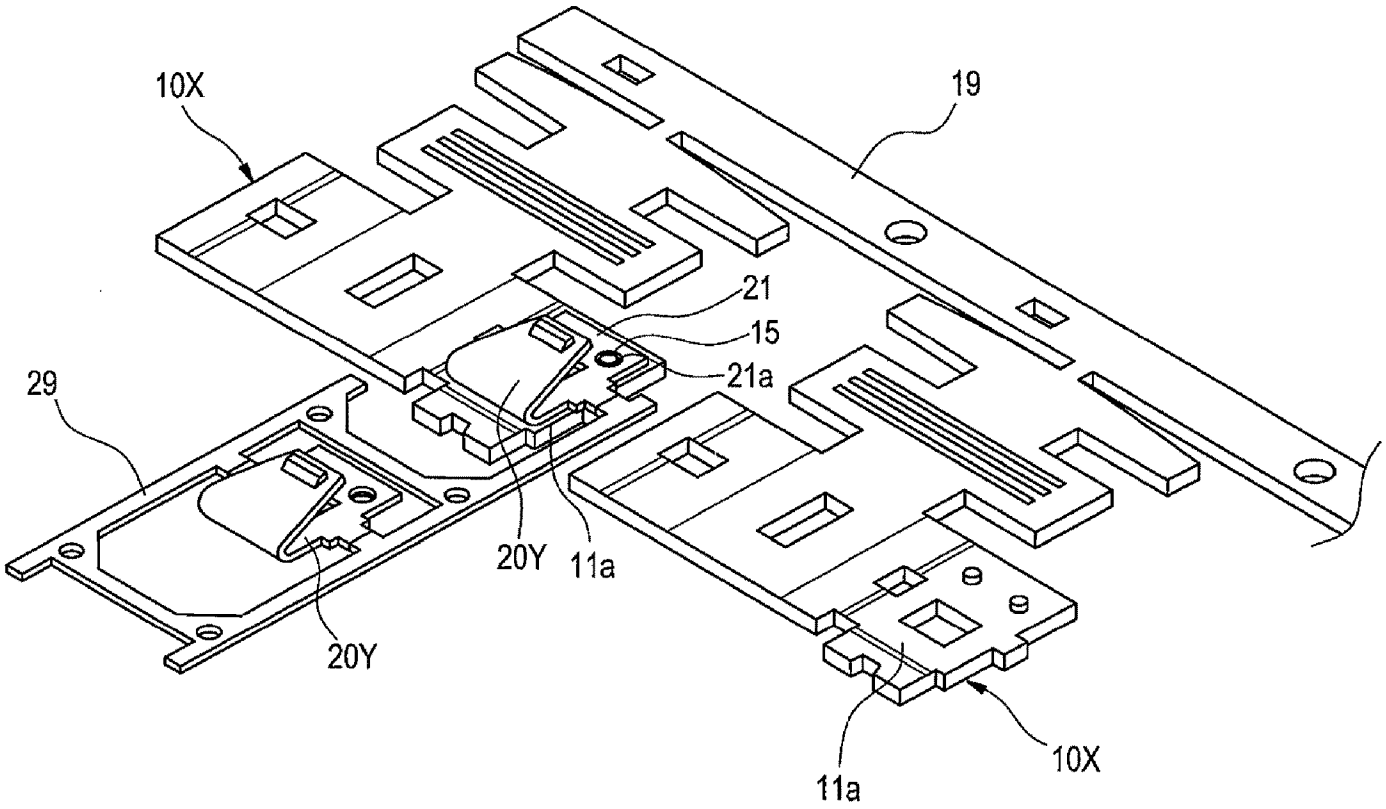
FIG. 5 is a perspective view of a state where the leaf spring on the second punching plate material shown in FIG. 4 is rivet-retained in the terminal base material on the first punching plate material.
Figure 6:
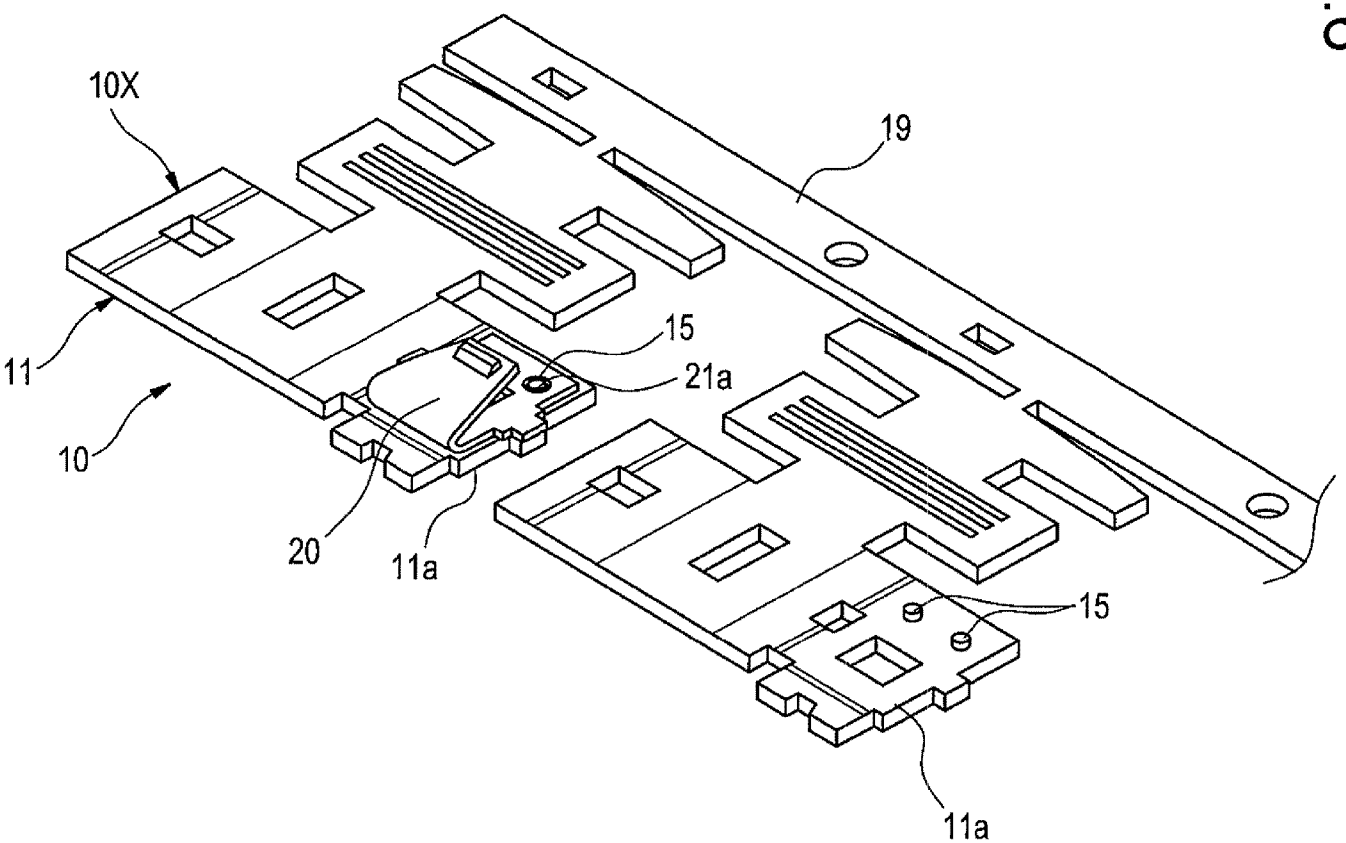
FIG. 6 is a perspective view of a state where the leaf spring rivet-retained in the terminal base material on the first punching plate material is separated from the second punching plate material.
Figure 7:
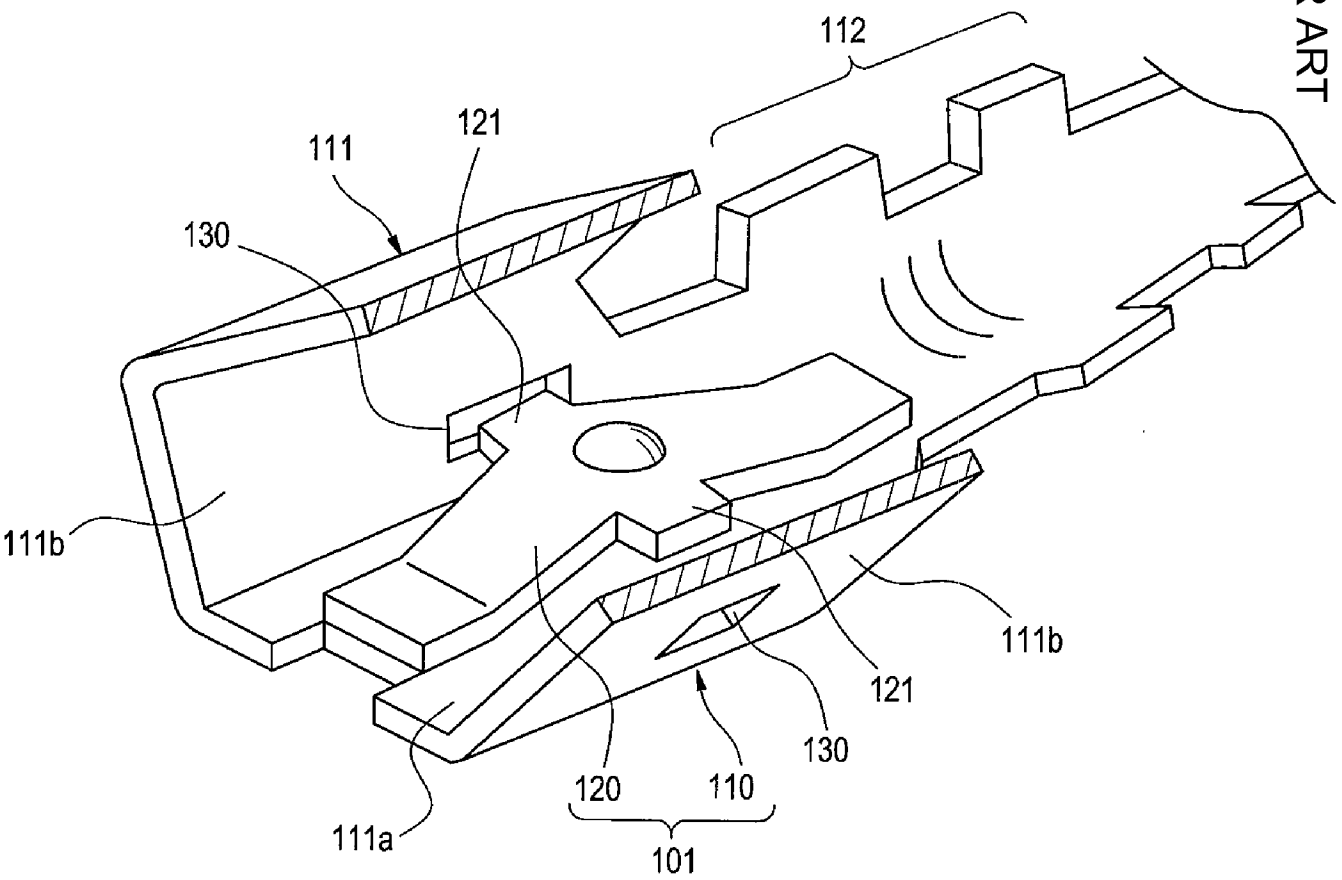
Fig.7 PRIOR ART
FIG. 7 is a perspective view that shows a fixing structure of a separate leaf spring in a female type terminal fitting of the related art.
Figure 8:
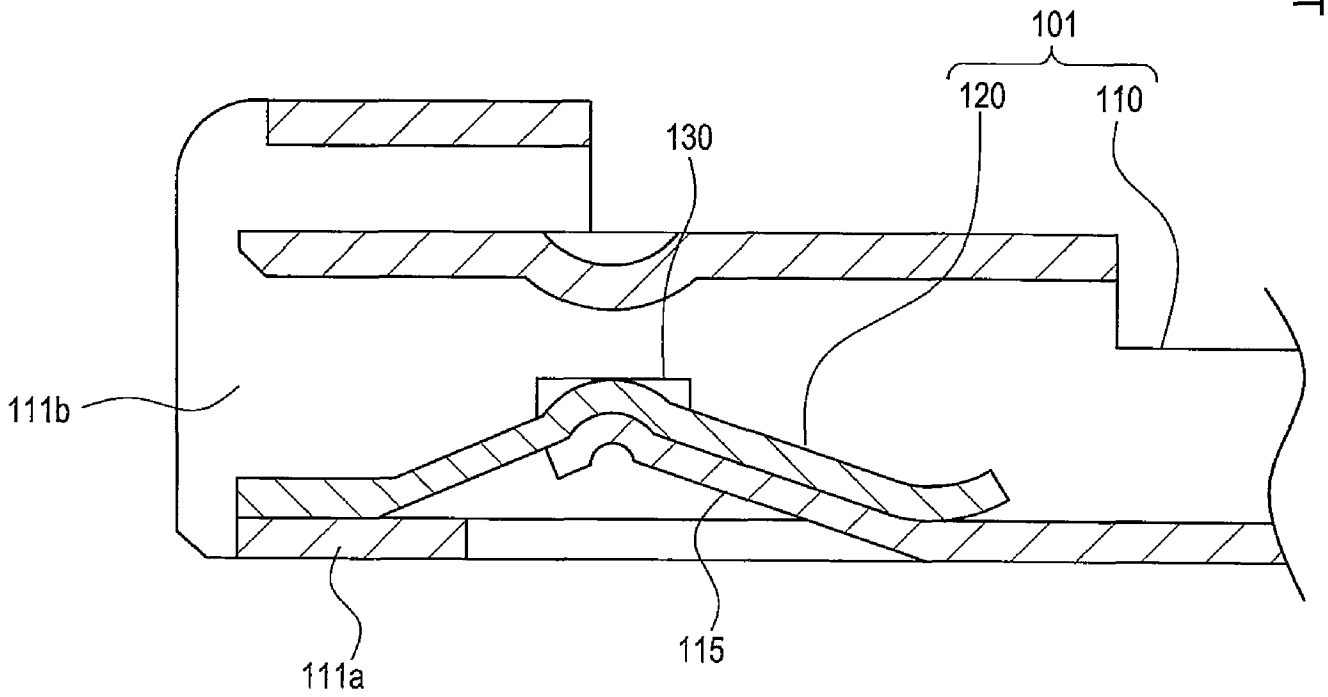
Fig.8 PRIOR ART
FIG. 8 is a longitudinal cross-sectional view of a press-molding completion state of the female type terminal fitting shown in FIG. 7.

FIGS. 1 to 6 show an embodiment of a fixing structure of a separate leaf spring according to the present invention. FIG. 1 is a perspective view of an embodiment of a female type terminal fitting to which a leaf spring is fixed by a fixing structure of a separate leaf spring according to the present invention. FIG. 2 is a longitudinal cross-sectional view of the female type terminal fitting shown in FIG. 1. FIG. 3 is a perspective view of a deployment shape of a terminal base material formed in the female terminal main body shown in FIG. 1 and the separate leaf spring fixed to the female terminal main body. FIG. 4 is a perspective view of a first punching plate material continuously formed with a plurality of terminal base materials shown in FIG. 3 and a second punching plate material continuously formed with a plurality of leaf springs. FIG. 5 is a perspective view of a state where the leaf spring on the second punching plate material shown in FIG. 4 is retained in the terminal base material on the first punching plate material. FIG. 6 is a perspective view of a state where the leaf spring retained in the terminal base material on the first punching plate material is separated from the second punching plate material.

A female terminal fitting 1 shown in FIGS. 1 and 2 includes a female terminal main body 10 formed by the press-molding of a metallic plate, and a leaf spring 20 made of a metallic plate which is formed separately from the female terminal main body 10 and is fixed to the female terminal main body 10.

The female terminal main body 10 includes a fitting cylinder section 11 of a square cylinder shape to which a male type terminal can be inserted, and an electric wire pressing section 12 connected to the back side of the fitting cylinder section 11. The fitting cylinder section 11 and the electric wire pressing section 12 are formed by the press-molding.

The fitting cylinder section 11 forms a rectangular cylinder structure formed of five plates which include a first side plate 11*a* covering an upper section in FIG. 2, a pair of second side plates 11*b* and 11*c* bent and molded on both sides of the first side plate 11*a* in a vertically standing state, a third side plate 11*d* covering the lower section facing the first side plate 11*a*, and a fourth side plate 11*e* formed on one end of the first side plate 11*a* in an overlapping form.

The electric wire pressing section 12 includes a conductor clamping piece 12*a* which compresses a conductor of the electric wire, and an electric wire clamping piece 12*b* which fixes a covered section of the electric wire.

FIG. 3 shows a terminal base material 10X which is a material prior to formation into the female terminal main body 10. The terminal base material 10X is formed by punching a metallic plate in a deployment shape of the female terminal main body 10. As shown in FIG. 4, the terminal base material 10X is firstly punched in a state where a plurality of terminal base materials 10X are connected to each other by a connection frame 19. In addition, in the deployment state shown in the terminal base material 10X, by denoting the same reference numerals as those of each part after the molding, the placement of each part is shown.

As shown in FIGS. 1 and 3, in the case of the female terminal main body 10, as means for fixing the leaf spring 20, a columnar body 15 for a rivet, and a spring fixing hole 16 are included.

As shown in FIG. 3, a plurality of (herein, two) columnar bodies 15 for the rivet protrude from an inner surface of the first side plate 11*a* which is one of a plurality of side plates constituting the fitting cylinder section 11.

The spring fixing hole 16 is a hole for fixing the leaf spring 20, and as shown in FIGS. 1 and 3, is formed through a pair of second side plates 11*b* and 11*c* facing each other.

As shown in FIGS. 2 and 3, the leaf spring 20 includes a rivet retaining section 21, a fixing plate 22 connected to one end of the rivet retaining section 21, a spring main body 23 which is folded from the tip of the fixing plate 22 to the rivet retaining section 21 side, and a pair of fixing pieces 24 which is extended and formed on both sides of the fixing plate 22.

A rivet insertion hole 21*a*, into which the columnar body 15 for the rivet is inserted, is formed through the rivet retaining section 21 corresponding to the arrangement of the columnar body 15 for the rivet in the first side plate 11*a*. The rivet retaining section 21 is fixed to the first side plate 11*a* by clamping the top section of the columnar body 15 for the rivet inserted to the rivet insertion hole 21*a*.

The fixing plate 22 is a plate-like section which comes into surface-contact with the first side plate 11*a* together with the rivet retaining section 21, and is extended to one side of the rivet retaining section 21.

The spring main body 23 is a tongue-like piece extended and formed to the tip of the fixing plate 22, and is a part which comes into pressure-contact with the male type terminal inserted to the fitting cylinder section 11.

The fixing pieces 24 are parts which are fixed to the fitting cylinder section 11 by being fitted to the spring fixing holes 16 formed in the second side plates 11*b* and 11*c*. The fixing pieces 24 are provided on both sides of the fixing plate 22.

As shown in FIGS. 1 and 2, the leaf spring 20 of the present embodiment is fixed to an inner section of the fitting cylinder section 11 using the columnar body 15 for the rivet inserted to the rivet insertion hole 21*a* and the positional restriction of the fitting of the fixing piece 24 to the spring fixing hole 16. The plate spring 20 fixed into the fitting cylinder section 11 presses the male type terminal inserted to the fitting cylinder section 11 by the spring main body 23, and makes the male type terminal and the fitting cylinder section 11 the conduction connection state.

FIG. 4 shows a spring base material 20X which is a material prior to molding into the leaf spring 20, and a secondary spring base material 20Y formed by bending a part of the spring base material 20X.

The spring base material 20X is made by punching a metallic plate to a deployed shape of the leaf spring 20. The spring base material 20Y is made by molding the spring main body 23 in the spring base material 20 into a final bending shape. In the state of the spring base material 20X and the secondary spring base material 20Y, a plurality of base materials are handled by a shape in which a plurality of base materials are connected by the connection frame 29. In addition, in the deployed shape shown in the spring base material 20X, by denoting the same reference numeral as those of each part after the molding, the displacement of each part is shown.

In the case of the female type terminal fitting of an embodiment, the fixing of the leaf spring 20 to the fitting cylinder section 11 is performed by the sequence below.

Firstly, as shown in FIG. 5, by fitting the columnar body 15 for the rivet on the terminal base material 10X to the rivet insertion hole 21*a* of the secondary spring base material 20Y in which the bending of the spring main body 23 is completed, the secondary spring base material 20Y is positioned in the first side plate 11*a* of the terminal base material 10X.

Next, the top section of the columnar body 15 for the rivet is clamped to perform the fixing, and the secondary base material 20Y is separated from the connection frame 29. Thus, as shown in FIG. 6, a form is obtained in which the leaf spring 20 is retained to the first side plate 11*a* of the terminal base material 10X.

Next, by applying a predetermined press processing to the terminal base material 10X to which the leaf spring 20 is retained, the female type terminal fitting 1 shown in FIGS. 1 and 2 is obtained.

That is, in the fixing structure of the separate leaf spring in the present embodiment, the fitting cylinder section 11 obtains a structure in which the leaf spring 20 is fixed into the inner section of the fitting cylinder section 11 by performing the press-molding in the square cylinder shape after retaining the leaf spring 20 to the first side plate 11*a* in the deployed shape and before performing the press-molding in the square cylinder shape.

Furthermore, in the process of performing the press-molding of the terminal base material 10X, to which the leaf spring 20 is retained, in the square cylinder shape, when the second side plates 11*b* and 11*c* of the fitting cylinder section 11 are bent and molded in a state of standing from the deployed state shown in the terminal base material 10X to the both side edges of the first side plate 11*a*, the fixing piece 24 is fitted to the spring fixing hole 16, whereby a state is obtained where the both sides of the fixing plate 22 of the leaf spring 20 are fixed.

According to the fixing structure of the separate leaf spring in an embodiment mentioned above, when performing the press-molding of the fitting cylinder section 11 of the female terminal main body 10 in the square cylinder shape, the separate leaf spring 20 is fixed to the first side plate 11*a* by retaining in advance. Thus, when performing the press-molding of the fitting cylinder section 11 of the female terminal main body 10, there is no need to cut and form a high precision positioning piece for preventing the positional deviation of the leaf spring 20 in the fitting cylinder section 11. Furthermore, the position of the leaf spring 20 does not deviate due to the impact or the like when performing the press-molding the fitting cylinder section 11.

Thus, it is easy to secure the strength in the fitting cylinder section 11 to which the leaf spring 20 is fixed. Furthermore, since there is no need for the high precision press-molding of less impact, the molding properties of the female terminal main body 10 can be improved.

Furthermore, according to the fixing structure of the separate leaf spring in an embodiment, since the fixing of the separate leaf spring 20 to the fitting cylinder section 11 has a double fixing structure achieved by retaining to the first side plate 11*a* and the fitting structure in which the fixing piece 24 equipped in the leaf spring 20 is fitted to the spring fixing hole 16 of the second side plates 11*b* and 11*c*, it is possible to improve the reliability of the fixing to the separate leaf spring 20.

In addition, the fixing structure of the separate leaf spring of the present invention is not limited to the various embodiments mentioned above, but suitable modifications, improvements or the like are possible.

For example, in the respective embodiments mentioned above, as the fixing means of the separate leaf spring to the fitting cylinder section, the double fixing structure has been adopted by also including the fitting structure in which the fixing piece equipped in the leaf spring is fitted into the spring fixing hole of the fitting cylinder section. However, in a case where it is possible to secure sufficient fixing strength with only the rivet retaining section, the fitting structure of the fixing piece and the spring fixing hole may be omitted.

This application is based upon and claims the benefit of priority of Japanese Patent Application No. 2011-140765 filed on Jun. 24, 2011, the contents of which are incorporated herein by reference.

INDUSTRIAL APPLICABILITY

According to the fixing structure of the separate leaf spring of the present invention, when performing the press-molding of the fitting cylinder section of the female terminal main body in a square cylinder shape, the separate leaf spring is fixed to the first side plate by the retaining in advance. Thus, there is no need to cut and form the high precision positioning piece for preventing the positional deviation of the leaf spring when performing the press-molding of the fitting cylinder section of the female terminal main body, in the fitting cylinder section. Furthermore, the position of the leaf spring does not deviate due to the impact or the like when performing the press-molding of the fitting cylinder section.

REFERENCE SIGN LIST

1: female type terminal fitting
10: female terminal main body
11: fitting cylinder section
11*a*: first side plate
11*b*, 11*c*: second side plate
15: columnar body for rivet
16: spring fixing hole
20: leaf spring
21: rivet retaining section
21*a*: rivet insertion hole
24: fixing piece

The invention claimed is:

1. A fixing structure of a separate leaf spring in a female type terminal fitting, the fixing structure comprising:

a female terminal main body extending in an axial direction and including a fitting cylinder section press-molded in a square cylinder shape and into which a male type terminal can be inserted, the fitting cylinder section including a plurality of side wall plates forming the female main body into the square cylinder shape; and a leaf spring formed separately from the female terminal main body and fixed to the fitting cylinder section so that the male type terminal can be pressed by the leaf spring;

wherein the fitting cylinder section includes a first side plate of the plurality of side wall plates from which a columnar body protrusion protrudes, the columnar body being monolithically formed with the first side plate;

wherein the leaf spring includes a protrusion retaining section that has an insertion hole into which the columnar body protrusion can be inserted, and that is fixed to the first side plate by the protrusion retaining section that retains a top section of the columnar body protrusion inserted in the insertion hole;

wherein the leaf spring further includes:

a fixing plate connected to the protrusion retaining section; and a tongue-like piece which is folded from a tip edge of the fixing plate to extend towards the protrusion retaining section in the axial direction, wherein the fixing plate and the protrusion retaining section are in surface-contact with the first side plate of the fitting cylinder, wherein the leaf spring includes at least two fixing pieces which each protrude from sides of the fixing plate, and each protrude toward a respective one of a second side plate and a third side plate of the fitting cylinder section, each of the second side plate and the third side plate of the plurality of side wall plates being bent and molded at a side edge of the first side plate in a standing state, wherein each of the second side plate and the third side plate of the fitting cylinder section includes a spring fixing hole into which a fixing piece of the at least two fixing pieces is fitted into, wherein each fixing piece is shaped as a flat plate, and extends in a plane which is a same plane as an extending plane in which both of the protrusion retaining section and the fixing plate extend; and wherein the tip edge of the fixing plate from which the tongue-like piece is folded and an edge of the fixing plate to which the protrusion retaining section is connected are disposed opposite each other in the axial direction.

2. The fixing structure of the separate leaf spring according to claim 1, wherein an extending plane of the at least two fixing pieces is parallel with an extending plane of the first side plate of the fitting cylinder section.

3. The fixing structure of the separate leaf spring according to claim 2, wherein both end portions of each of the fixing pieces in an insertion direction of a male type terminal abut against a respective spring fixing hole so that movements of the fixing pieces in the insertion direction of the male type terminal are restricted.

4. The fixing structure of the separate leaf spring according to claim 1, wherein an extending plane of the at least two fixing pieces is perpendicular to an insertion direction where the columnar body protrusion inserts into the insertion hole.

5. The fixing structure of the separate leaf spring according to claim 1, wherein the first side plate is formed continuously with the second side plate of the fitting cylinder section and formed discontinuously with the third side plate, and the second side plate and the third side plate are formed continuously with respective opposite sides of the fourth side plate of the plurality of side wall plates.

6. The fixing structure of the separate leaf spring according to claim 1, wherein the insertion hole is not located underneath the tongue-like piece.

7. The fixing structure of the separate leaf spring according to claim 1, wherein the tongue-like piece extends toward the protrusion retaining section in the axial direction but not beyond the protrusion retaining section.

* * * * *